United States Patent [19]

Jones

[11] 3,977,723

[45] Aug. 31, 1976

[54] FURNITURE COMBINATION

[76] Inventor: Ferris E. Jones, 943 Millbury Ave., La Puente, Calif. 91746

[22] Filed: Dec. 30, 1974

[21] Appl. No.: 537,258

[52] U.S. Cl. ..... 297/173

[51] Int. Cl.[2] ..... A47B 39/00

[58] Field of Search ..... 297/331, 421, 187, 140, 297/141, 174, 162, 154; 248/439, 240.2, 298; 108/1, 2, 6, 7, 50, 136, 48

[56] References Cited

UNITED STATES PATENTS

| | | | |
|---|---|---|---|
| 623,008 | 4/1899 | Grieb et al. | 297/141 X |
| 956,024 | 4/1910 | Ballam | 297/141 |
| 958,529 | 5/1910 | Phillips | 297/411 |
| 1,652,100 | 12/1927 | Eastburn | 297/141 |
| 1,657,307 | 1/1928 | Hisev et al. | 297/141 |
| 2,807,512 | 9/1957 | Blink | 108/38 |
| 3,398,988 | 8/1968 | Noe | 297/187 X |

*Primary Examiner*—James T. McCall
*Attorney, Agent, or Firm*—Boniard I. Brown

[57] ABSTRACT

A furniture combination including an article of furniture, such as a seat or table, which is pivotally mounted on a support to swing vertically and is spring urged to an elevated position above the floor to permit cleaning of the floor area below the article. The article is latched in its normally lower position of use. The furniture support may be another article of furniture, such as a seat, table, or bar.

13 Claims, 3 Drawing Figures

10
12
14
16
18
19
20
22
24
26
27
28
30
32
34
35
36
38
40
43
44
46
48
50
52
54
56
58
60
62
64
66
68
70
72
74
76

10
12
14
16
18
19
20
22
24
26
27
28
30
32
34
35
36
38
40
43
44
46
48
50
52
54
56
58
60
62
64
66
68
70
72
74
76

10
12
14
16
18
19
20
24
26
28
32
34
38
40
43
44
50
52
54
56
58
68
74
76

FURNITURE COMBINATION

RELATED APPLICATIONS

Reference is made to application Ser. No. 546,204 filed Feb. 3, 1975, which is a continuation-in-part of Ser. No. 488,909 filed July 16, 1974 now abandoned.

BACKGROUND OF THE INVENTION

1. Field of the Invention

This invention relates generally to furniture and more particularly to a novel furniture combination including an article of furniture hinged to a support in such a way that the article may be raised to an elevated position above the floor to permit cleaning of the floor area below the article.

2. Prior Art

Restaurants, cafes, cocktail lounges and other similar commercial dining and drinking establishments present a floor cleaning problem owing to the large number of seats and tables which are commonly utilized in such places. At the present time, for example, when cleaning the floor of such an establishment, any one of three different procedures may be followed. The tables and seats may be removed in mass from the floor, or the tables and seats may be shifted about on the floor as the latter is cleaned, or the tables and seats may be left in place. The first two procedures obviously present a laborious and time consuming task. The third procedure, while perhaps not as time consuming, renders the cleaning task more tedious and less thorough. A similar but not so large a floor cleaning problems exists in private homes, particularly those having dining nooks with a booth and table. My earlier referenced co-pending application discloses a unique furniture combination which alleviates these cleaning problems by pivotally mounting an article of furniture, such as a table, seat or the like, on a support in such a way that the article may be elevated to facilitate cleaning below the article. Other examples of furniture combinations of the general class are described in the following patents: U.S. Pat. Nos. 372,881; 1,026,140; 1,256,811; 1,359,118; 1,417,655; 1,448,253; 1,513,907; 1,652,100; 1,657,307; 1,664,766; 1,728,723; 2,321,177; 2,521,160; 2,845,114; French Pat. No. 910,639; and Italian Pat. No. 480,408.

SUMMARY OF THE INVENTION

The present invention provides an improved furniture combination of the kind disclosed in my co-pending application. This improved furniture combination; like that of my prior application, includes an article of furniture, such as a seat or table, a furniture support, and means pivotally mounting the article on the support to swing up and down in a manner which permits the article to be elevated to a raised position above the floor to permit cleaning of the floor area below the article. The furniture support may be another article of furniture, such as a table, seat or bar. The furniture article is spring biassed to its elevated position to facilitate raising of the article and is retained in its normal lower position of use by a releasible latch. The biassing spring is adjustable to regulate the upward force on the article. This spring force may be set to raise the furniture article by spring action alone or by application of a light lifting force to the article.

In the disclosed embodiment of the invention, the furniture support is a seat and the pivotally supported article of furniture is a table. However, the pivotally supported furniture article may be other than a table and the article support may be other than a seat. In this regard, it is worthy of note at the outset that in the context of the present disclosure, the terms "table", "seat", and "furniture" are used in a broad sense to mean any table and seat or table and seat-like articles for either commercial or home use. The term "article support" means any suitable supporting structure.

DESCRIPTION OF THE PREFERRED EMBODIMENT

Figure 1:
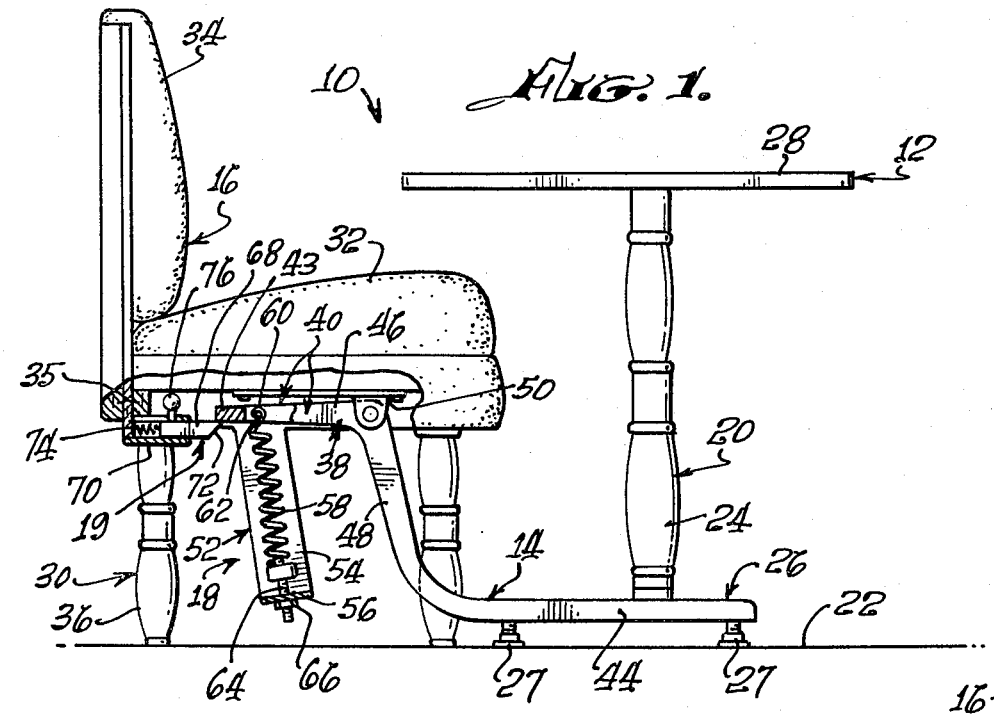
FIG. 1 is a side elevation of a furniture combination according to the invention, showing the pivotally supported furniture article in its normal lower position of use.
Figure 2:
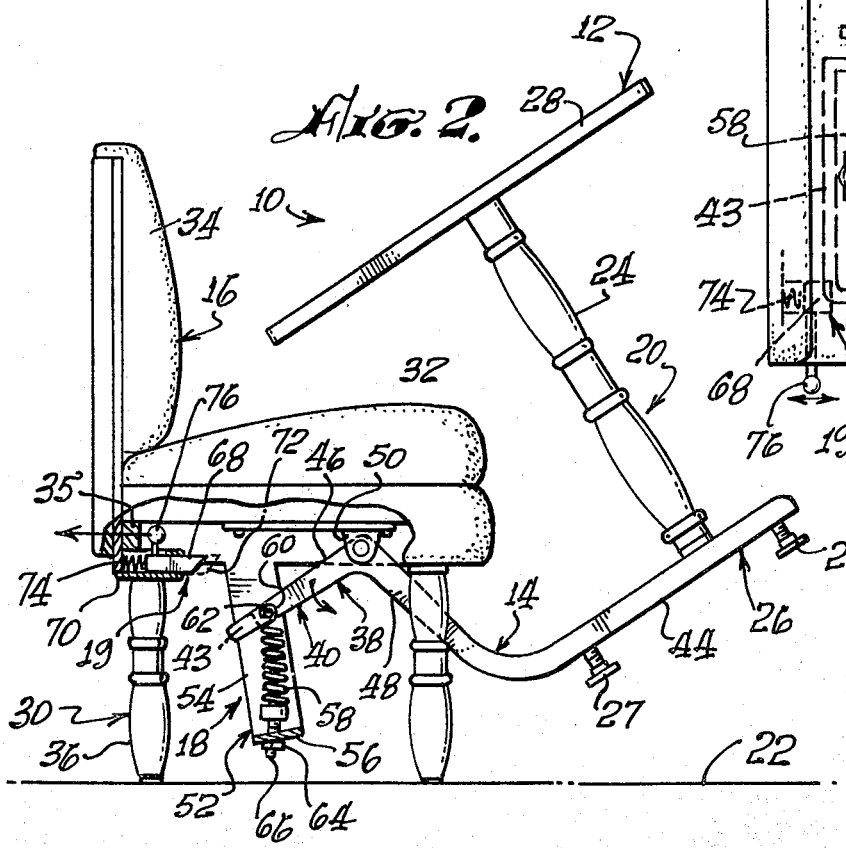
FIG. 2 is a view similar to FIG. 1 showing the furniture article fixed in raised position.
Figure 3:
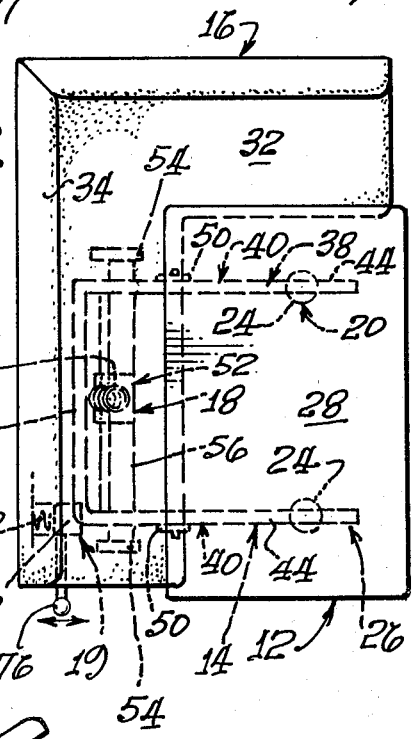
FIG. 3 is a top plan view of the furniture combination.

The drawings illustrate a furniture combination 10 according to the invention including an article of furniture 12 attached by pivotal mounting means 14 to a support 16 in such a way that the article may be raised and lowered between a normal position of use, shown in FIG. 1, and a raised cleaning position, shown in FIG. 2. Means 18 are provided for resiliently biassing the furniture article to its raised position. The article is releasibly retained in its lower position of use by releasible latch means 19. The article has a supporting base 20 which rests on the floor 22 in the lower position of use of the article and is elevated above the floor to permit cleaning of the floor below the article when the latter occupies its raised position.

In the particular inventive embodiment illustrated, the furniture article 12 is a table, the base 20 of which is a pedestal including a pair of supporting columns 24 and a base portion 26 at the bottom of the columns with adjustable pads 27 for resting on the floor. The table top 28 is mounted at the upper end of the column 24 and may be adjustable toward and away from the support 16.

Support 16 is a seat including a lower supporting base 30, a seat cushion 32 fixed to the top of the base, and a cushioned back rest 34 fixed to the rear side of and rising from the base. Base 30 has an upper seat frame 35 and vertical support members or legs 36 depending from the frame. When in its lowered position, the table 12 is located in a convenient position of use in front of the seat, as shown.

The illustrated article or table mounting means 14 comprises a generally v-shaped frame 38 having a pair of generally z-shaped arms 40 joined by a cross member 43 such that the frame is generally z-shaped in side elevation. Each frame arm 40 has a normally lower front portion 44, a normally upper rear portion 46 above, rearwardly of and parallel to the front portion, and a central upright portion 48 extending between and joining the front and rear portions. Cross member 42 extends between and joins the rear ends of the two rear arm portions 46. Frame 38 is pivotally attached, at the junctures of its rear arm portions 46 and central arm portions 48, to the underside of the seat frame 35 by means of pivot brackets 50. The pivot axis of the mounting frame 38 is located rearwardly of and parallel to the front edge of the seat frame, whereby the mounting frame is vertically swingable between its positions of FIGS. 1 and 2. The table columns 24 are secured at their lower ends to the lower mounting frame arm portions 44 which together constitute the table pedestal base portion 26. From this description, it will be understood that mounting frame 38 and its pivot brackets 50 support the table 12 on the seat 16 for swinging of the table between its lower use position of FIG. 1 and its raised cleaning position of FIG. 2.

As noted earlier, the table 12 is resiliently biassed to its raised cleaning position by means 18. Biassing means 18 comprises a generally v-shaped spring bracket 52 secured to and depending from the underside of the seat frame 35. Bracket 52 has arms 54 secured to the seat frame and joined at their lower ends by a cross member 56 which is located a distance below the rear portion of the table mounting frame 38 in parallel relation to the frame cross member 42. A spring 58 is connected between the rear mounting frame portion and the lower bracket cross member 56 for urging front portion of the mounting frame and the table 12 upwardly to the raised position of FIG. 2. The upper end of spring 58 has a hook 60 which engages over a rod 62 which extends between and is secured at its ends to the rear mounting frame arm portions 46, forwardly of the mounting frame cross member 42. Secured to the lower end of the spring 58 is a threaded stem 64 which extends loosely through an opening in the lower cross member 56 of the spring bracket 52. Threaded on the lower end of the stem 64, below the bracket cross member 56, is a nut 66 which is adjustable along the stem to adjust the tension of spring 58. The spring tension may be set to effect biassing of the table 12 to its raised position by spring action alone or by the addition of a light lifting force to the table.

Releasible latch means 19 retains the table 12 in its lower use position of FIG. 1 against the upward bias of spring 58. Latch means 19 comprises a latch bar 68 which is slidably positioned within a guideway 70 in the rear of the seat frame 35 for movement in the face and aft direction of the frame. The front edge of the latch bar is beveled, as shown, to provide an inclined cam face 72. The latch bar is movable between its position of FIG. 1, shown in broken lines in FIG. 2, hereafter referred to as its latching position, and its solid line position of FIG. 2, hereafter referred to as its retracted position. A spring 74 urges the latch bar to its latching position, where the bar is arrested by limit stop means (not shown). Fixed to the latch bar is a handle 76 which extends beyond one end of the seat 16 for retracing the bar.

In the latching position of the latch bar 68, its front cam face 72 is located in the path of swinging movement of the rear cross member 42 of the table mounting frame 38, such that during lowering of the table 12 to its position of use, the cross member engages the cam face and cams the latch bar to its retracted position. The frame cross member 42 swings upwardly to a position above the latch bar, which then snaps to its latching position below the cross member to latch the table in its position of use. The table is released to swing upwardly to its raised cleaning position by grasping the latch bar handle 76 and retracting the bar rearwardly to clear the table mounting frame.

As noted earlier, the tension of table biassing spring 58 may be set to raise the table 12 by spring action alone. In this case, the table will raise automatically upon retraction of the latch bar 68 and is lowered to its use position by applying a light downward force to the table. If the spring is set at a lesser tension, a light upward force must be applied to the table to elevate it to its raised position. During upward swinging of the table, its center of gravity moves inwardly toward the pivot axis of the table mounting frame 38 sufficiently to enable the spring to retain the table in its raised position. The table is lowered by applying a light downward force to the table.

The inventor claims:

1. A furniture combination comprising:

a support, arm means rigidly fixed at one end to said article and extending laterally of said article toward said support at a fixed angle relative to said article, an article of furniture in front of said support, means pivotally mounting said arm means on said support adjacent the one end of said arm means for vertical swinging movement of said article between a lower position of use wherein the article rests on the floor and a raised position wherein the article is elevated above the floor to permit cleaning the floor below the article, and means connected between said support and said arm means for resiliently biassing said article upwardly to said raised position.

2. The furniture combination according to claim 1 including:

latch means for releasibly latching said article in said use position.

3. The furniture combination according to claim 2 wherein:

said biassing means comprises a spring, and the upward bias force exerted on said article by said spring is sufficient to elevate said article to and retain the article in said raised position.

4. The furniture combination according to claim 1 wherein;

said biassing means comprises a spring, and means for adjusting the upward bias force exerted on said article by said spring through a range including a force which is sufficient to raise said article to and retain the article in said raised position and a force which is insufficient to raise said article to but sufficient to retain the article in said raised position.

5. The furniture combination comprising:

a support including a frame located above floor level, means swingably mounting said article on said support for swinging vertically between a lower position of use wherein the article rests on the floor and a raised position wherein the article is elevated above the floor to permit cleaning the floor below the article, said mounting means comprising a frame pivotally mounted between its ends on said support frame and having a front end secured to said article, and a spring acting between support frame and the rear end of said article mounting frame for exerting a downward bias force on said latter frame end to resiliently bias said article to said raised position.

6. The furniture combination according to claim 5 including:

means for adjusting said bias force, and latch means for releasibly latching said article in its lower use position.

7. The furniture combination according to claim 6 wherein:

said latch means comprises a latch member on said support engagable with the rear end of said mounting frame.

8. A furniture combination comprising:

a seat having a frame located above floor level, a table in front of said seat having a pedestal and a table top on the upper end of said pedestal, means pivotally mounting said table on said seat for swinging vertically between a lower position of use wherein the table rests on the floor and a raised position wherein the table is elevated above the floor to permit cleaning the floor below the table, said mounting means comprising a generally z-shaped mounting frame having a lower front end portion secured to the bottom of said pedestal and forming a table base for resting on the floor in said lower use position of said table, an upper rear end portion positioned below said seat frame, and a central upright portion between and joining said end portions, and means pivotally mounting said mounting frame on the underside of said seat frame at the juncture of said rear and central frame portions, and a spring bracket depending from the underside of said seat frame and below said rear mounting frame portion, and a spring connected between said rear frame portion and the lower end of said spring bracket for exerting an upward bias force on said table.

9. The furniture combination according to claim 8 including:

a latch member mounted on the underside of said seat frame for movement into and from latching engagement with said rear mounting frame portion when said table is in said lower use position for releasibly latching the table in said latter position.

10. The furniture combination according to claim 9 wherein:

said mounting frame has a pair of generally z-shaped arms providing said front, rear, and central frame portions and a cross member joining the rear ends of said arms, said latch member comprises a latch bar extendable forwardly of said seat to a latching position under said frame cross member to latch said table in its lower use position and retractable rearwardly to release said table to swing to its raised position, and having a front inclined cam face engagable by said cross member to retract said bar during downward swinging of said table to its position of use, and a spring for urging said latch bar to latching position.

11. The furniture combination according to claim 10 including:

means for adjusting the tension of said table biassing spring to adjust said bias force.

12. The furniture combination according to claim 1 wherein:

said biassing means comprises a spring, and the upward bias force exerted on said article by said spring is sufficient to retain said article in but slightly less than the bias force required to elevate said article to said raised position.

13. The furniture combination according to claim 1 wherein:

the pivot axis of said arm means is located between the ends of said arm means, and said biassing means comprises a spring for exerting a downward bias force on said other end of said arm means.

* * * * *